US007309685B2

(12) United States Patent
Wachter et al.

(10) Patent No.: US 7,309,685 B2
(45) Date of Patent: Dec. 18, 2007

(54) TEXTILE FINISHING AGENTS FOR IMPARTING A SENSORY EFFECT DURING USE

(75) Inventors: Rolf Wachter, Duesseldorf (DE); Manfred Weuthen, Langenfeld (DE); Claudia Panzer, Grevenbroich (DE)

(73) Assignee: Cognis IP Management GmbH, Duesseldorf (DE)

( * ) Notice: Subject to any disclaimer, the term of this patent is extended or adjusted under 35 U.S.C. 154(b) by 27 days.

(21) Appl. No.: 10/544,949

(22) PCT Filed: Dec. 19, 2003

(86) PCT No.: PCT/EP03/14593

§ 371 (c)(1),
(2), (4) Date: May 11, 2006

(87) PCT Pub. No.: WO2004/069980

PCT Pub. Date: Aug. 19, 2004

(65) Prior Publication Data

US 2006/0258558 A1 Nov. 16, 2006

(30) Foreign Application Priority Data

Feb. 10, 2003 (DE) ..... 103 05 552

(51) Int. Cl.
*C11D 1/83* (2006.01)
*D06M 13/224* (2006.01)

(52) U.S. Cl. ..... 510/287; 510/276; 510/357; 510/426; 510/437; 510/470; 510/515; 510/516; 8/115.51; 8/115.56; 8/151.2; 28/217; 28/219

(58) Field of Classification Search ..... 8/115.51, 8/115.6, 151.2; 28/217, 219; 510/276, 287, 510/357, 426, 437, 470, 515, 516
See application file for complete search history.

(56) References Cited

U.S. PATENT DOCUMENTS

| | | | | |
|---|---|---|---|---|
| 3,434,874 | A | 3/1969 | Proffitt, Jr. | |
| 4,997,641 | A * | 3/1991 | Hartnett et al. | 424/70.122 |
| 5,051,250 | A * | 9/1991 | Patel et al. | 424/70.19 |
| 5,346,642 | A * | 9/1994 | Patel et al. | 510/122 |
| 5,348,736 | A * | 9/1994 | Patel et al. | 424/70.9 |
| 5,415,857 | A * | 5/1995 | Robbins et al. | 424/70.122 |
| 5,503,755 | A | 4/1996 | Danner | |
| 5,723,137 | A | 3/1998 | Wahle et al. | |
| 6,056,947 | A * | 5/2000 | Kahre et al. | 424/70.13 |
| 6,656,454 | B1 * | 12/2003 | Koester et al. | 424/49 |
| 6,733,790 | B1 * | 5/2004 | Garces Garces | 424/497 |
| 7,098,178 | B2 * | 8/2006 | Gerke et al. | 510/466 |
| 2003/0161849 | A1 * | 8/2003 | Heidenfelder et al. | 424/401 |
| 2004/0037793 | A1 | 2/2004 | Nieendick et al. | |

FOREIGN PATENT DOCUMENTS

| | | |
|---|---|---|
| DE | 43 32 607 | 3/1994 |
| DE | 43 37 030 | 5/1995 |
| DE | 197 05 862 | 6/1998 |
| DE | 197 28 084 | 1/1999 |
| EP | 0 826 414 | 3/1998 |
| WO | WO 02/05781 | 1/2002 |

* cited by examiner

*Primary Examiner*—Charles Boyer
(74) *Attorney, Agent, or Firm*—John F. Daniels; Daniel S. Ortiz

(57) ABSTRACT

A method for treating fibers, yarns or textiles to improve the sensory effect for a user or weaver of a fabric article. The method treats the fiber, yarns or textiles with an emulsion containing 15-30% by weight of a mixture of waxes having melting points in the range of 35° C. to 60° C. including a lipophilic wax matrix; 10%-20% by weight of emulsifier which are at least one of alkyl or alkenyl oligoglycosides or alkyl ether sulfates, 1%-10% by weight of a crystal regulator which can be partial esters of $C_{12-22}$ fatty acids with at least one of glycerol, polyglycerol and sorbitan. The mean particle size of the wax crystals is not greater than 6 μm. The emulsion includes water and auxiliaries and additives.

20 Claims, No Drawings

TEXTILE FINISHING AGENTS FOR IMPARTING A SENSORY EFFECT DURING USE

RELATED APPLICATIONS

This application is filed under 35 U.S.C. § 371 claiming priority from application PCT/EP2003/014593 filed Dec. 19, 2003, which claims priority from German application DE 103 05 552.5 filed Feb. 10, 2003, the entire contents of each application are incorporated herein by reference.

FIELD OF THE INVENTION

This invention relates generally to the finishing of textiles and, more particularly, to new treatment preparations which impart a sensory effect to fibers, yarns or the textiles made from them during wear, to a process for the temporary finishing of these materials and to the use of special mixtures of waxes, emulsifiers and crystallization regulators for the production of such preparations.

BACKGROUND OF THE INVENTION

One of the most interesting trends in recent years in the textiles field has been the imparting of sensory capabilities to fibers or yarns or the end products made from them. By this is meant that the materials are finished with predominantly cosmetic active components which are released during wear and then develop effects on the skin. For example, ladies' stockings are finished with encapsulated menthol in order to impart a feeling of freshness, even after prolonged standing, or diapers are coated with aloe vera to prevent irritation of the skin. Now, however, there is a basic interest in finishing textiles with active components which modify the immediate sensory impression of the skin, i.e. for example impart a pleasant smoothness or moisture. A sufficient number of suitable substances, namely typical oil components, are known for this purpose from the cosmetics field and, by intelligent mixing, for example on the lines of a so-called spreading cascade, are capable of satisfying these requirements, even over a prolonged period. However, the problem lies not so much in the choice of suitable active components, where the expert can be guided by his/her experiences in the cosmetics field, as in the permanent application of these compounds from aqueous emulsions or dispersions which is not an easy task. Although the compounds in question can also be used in encapsulated form and the microcapsules can be anchored between the fibers, this method is still comparatively expensive.

Accordingly, the problem addressed by the present invention was to provide new textile finishing preparations with which active components with sensory effects activated by the heat of the skin or by application of heat, for example during ironing or in the dryer, could be applied to fibers, yarns or textile materials made from them in a technically simple and durable manner.

BRIEF DESCRIPTION OF THE INVENTION

The present invention relates to water-based textile finishing preparations containing (a) waxes with melting points of 35 to 60° C. and preferably 40 to 45° C. which contain a lipophilic wax matrix, (b) emulsifiers and (c) crystallization regulators.

It has surprisingly been found that the ternary mixtures according to the invention satisfy the problem stated above with a high degree of reliability. The preparations may readily be applied from the aqueous phase, the melting point of the sensorially active waxes being selected so that it is preferably just above the surface temperature of the skin. In this way, the sensory capabilities of these active components are developed immediately on contact with the skin through the co-operation between the skin temperature and the mechanical friction between textile and skin. The emulsifiers ensure that the waxes insoluble in the aqueous phase are sufficiently emulsified or dispersed in the aqueous phase for a homogeneous preparation to be formed. However, the major contribution to the invention is made by the crystallization regulators, of which the function is to ensure that the wax crystals do not become too large during the production of the preparations, for example by the PIT process or by simple mixing of the components above the melting point of the waxes and subsequent cooling. The present invention includes the observation that waxes with a mean particle diameter of more than 6 μm cannot be durably applied to fibers, with the result that the desired sensory effect is not experienced by the consumer.

DETAILED DESCRIPTION OF THE INVENTION

Lipophilic Waxes

As mentioned above, the choice of the lipophilic waxes in regard to type is not critical. It is determined by the particular sensory effects to be produced on the skin, for which purpose the expert can rely largely on his/her experiences in the cosmetics field. It is appropriate to use waxes with a melting point just above the temperature of the skin surface because this ensures that the sensory effect is initiated immediately on contact with the skin. Waxes with distinctly lower melting points are more difficult to incorporate in the formulations and are susceptible to temperature influences in storage; waxes with distinctly higher melting points are virtually ineffectual on contact with the skin. An exception would be preparations where the sensory effect (for example easy ironing) is initiated otherwise, as in the case of ironing for example. In this connection, it is appropriate not to use a single wax on its own, but to resort to spreading cascades, i.e. to use waxes which produce different sensory impressions and/or need different times to be activated. In this way, the intended effect can be made to last a long time (controlled release effect). It is also possible to combine waxes which only have the required melting range in the mixture. As already mentioned, however, the expert can call on his/her specialist knowledge for this purpose or can create formulations in the course of routine optimization without having to become involved in any inventive activity. Further assistance is provided by the Formulation Examples which are part of this specification.

Fatty Acid Polyol Esters

In a first embodiment of the present invention, the lipophilic waxes which form component (A) are mono- and/or diesters of $C_{6-22}$ fatty acids and $C_{2-15}$ polyols containing at least two hydroxyl groups.

The fatty acid component of these esters may be derived, for example, from caproic acid, caprylic acid, 2-ethylhexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof. The fatty acids are preferably saturated $C_{16-18}$ fatty acids such as, for example, palmitic acid, stearic acid or technical mixtures thereof.

On the other hand, the esters may be derived from polyols selected from the group consisting of glycerol; alkylene glycols such as, for example, ethylene glycol, diethylene glycol, propylene glycol, butylene glycol, hexylene glycol and polyethylene glycols with an average molecular weight of 100 to 1,000 dalton; technical oligoglycerol mixtures with a degree of self-condensation of 1.5 to 10 such as, for example, technical diglycerol mixtures with a diglycerol content of 40 to 50% by weight; methylol compounds such as, in particular, trimethylol ethane, trimethylol propane, trimethyol butane, pentaerythritol and dipentaerythritol; and lower alkyl glucosides, more particularly those containing 1 to 8 carbon atoms in the alkyl group, such as methyl and butyl glucoside for example.

In a preferred embodiment of this variant, component (a) is a mono- and/or diester of saturated $C_{16-18}$ fatty acids with ethylene glycol, propylene glycol, trimethylol propane or pentaerythritol and, more particularly, glycol mono- and/or distearate which is commercially available, for example, under the name of Cutina® AGS (Cognis).

Other Suitable Lipophilic Waxes

In a second embodiment of the present invention, component (a) may be another typical fatty compound selected from the group consisting of fatty alcohols, fatty ketones, fatty ethers, fatty carbonates, fatty acid alkyl esters, with the proviso that the fatty acyl group contains at least 12, preferably at least 14 and more particularly at least 16 carbon atoms and the temperature conditions mentioned at the beginning are satisfied.

Typical examples are the fatty alcohols cetyl alcohol, stearyl alcohol, isostearyl alcohol and behenyl alcohol and the technical mixtures thereof which, from their production, may also contain small quantities of unsaturated homologs, but preferably have iodine values of at most 40, but preferably below 10. Examples of suitable fatty ketones are laurone and stearone while examples of fatty ethers and fatty carbonates are dicetyl ether, distearyl ether, dicetyl carbonate and distearyl carbonate. So far as the fatty acid alkyl esters are concerned, suitable types are primarily those where the total number of carbon atoms in the acyl and alkyl groups is at least 20, preferably at least 24 and more particularly at least 30. Typical examples are myristyl palmitate, cetyl palmitate, stearyl stearate, behenyl isostearate and the like. However, particularly high-melting ester waxes may be mixed with low-melting homologs which would not be suitable on their own.

Alternatively, paraffins, sterols, squalane, squalene, shea butter, evening primrose oils, shorea waxes and the like may also be used as component (a).

Typically, the preparations according to the invention contain component (a) in quantities of 15 to 30 and, more particularly, 20 to 25% by weight.

Emulsifiers

The function of the emulsifiers is, self-evidently, to emulsify or disperse the fine wax crystals and hence to ensure that a homogeneous preparation is present and that the solids do not sediment for example. Basically, both nonionic and anionic surfactants may be used for this purpose. Thus regarded, the choice of suitable emulsifiers may also appear uncritical. However, it has been found that the correct combination of emulsifier and crystallization regulator together contributes to the formation of particularly fine particles which considerably facilitates the absorption of the wax crystals onto the fibers.

Nonionic Surfactants

Typical examples of suitable substances which form component (b) are nonionic surfactants selected from the group consisting of fatty alcohol polyglycol ethers, alkylphenol polyglycol ethers, fatty acid polyglycol esters, fatty acid amide polyglycol ethers, fatty amine polyglycol ethers, alkoxylated triglycerides, (hydroxy) mixed ethers and mixed formals, alk(en)yl oligoglycosides, fatty acid-N-alkyl glucamides, protein hydrolyzates, polyol fatty acid esters, sugar esters, sorbitan esters, polysorbates and amine oxides.

As mentioned above, selected emulsifiers have advantageous properties in regard to the formation of particularly fine wax crystals. Emulsifiers such as these are, primarily, alkyl and/or alkenyl oligoglycosides corresponding to formula (I):

$$R^1O\text{-}[G]_p \qquad (I)$$

in which $R^1$ is an alkyl and/or alkenyl group containing 4 to 22 carbon atoms, G is a sugar unit containing 5 or 6 carbon atoms and p is a number of 1 to 10. They may be obtained by the relevant methods of preparative organic chemistry. The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides. The index p in general formula (I) indicates the degree of oligomerization (DP), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view. The alkyl or alkenyl radical $R^1$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl radical $R^1$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ cocoalcohol with a DP of 1 to 3 are preferred.

Anionic surfactants

Other typical examples of suitable substances, which alternatively form component (b), are anionic surfactants selected from the group consisting of soaps, alkyl benzenesulfonates, alkane sulfonates, olefin sulfonates, alkyl ether sulfonates, glycerol ether sulfonates, α-methyl ester sulfonates, sulfofatty acids, alkyl sulfates, alkyl ether sulfates, glycerol ether sulfates, hydroxy mixed ether sulfates, monoglyceride (ether) sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acylamino acids, alkyl oligoglucoside sulfates, protein fatty acid condensates and alkyl (ether) phosphates.

Alkyl ether sulfates which have been found to be particularly advantageous are those which preferably correspond to formula (II):

$$R^2O(CH_2CH_2O)_n—SO_3X \quad (II)$$

in which $R^2$ is a linear or branched, aliphatic alkyl and/or alkenyl group containing 6 to 22 and preferably 12 to 18 carbon atoms, n is a number of 1 to 10 and preferably 2 to 5 and X is an alkali metal and/or alkaline earth metal, ammonium, alkylammonium, alkanol-ammonium or glucammonium. Typical examples of alkyl ether sulfates which may be used in accordance with the invention are the sulfation products of addition products of, on average, 1 to 10 and more particularly 2 to 5 mol ethylene oxide onto caproic alcohol, caprylic alcohol, capric alcohol, 2-ethylhexyl alcohol, lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol and erucyl alcohol and technical mixtures thereof. The sulfation products may advantageously be used in the form of their alkali metal salts and, more particularly, their sodium salts.

The emulsifiers of component (b) are present in the preparations in quantities of normally 10 to 20% by weight and preferably 12 to 18% by weight.

Crystallization Regulators

As explained at the beginning, the presence of crystallization regulators is crucially important to the application of the technical teaching. This is because, in their absence, wax crystals with mean diameters (d50 value) of 10 μm and more are formed during the production of emulsions or dispersions and generally cause the preparations to assume a pearlescent appearance. Although such preparations are not without effect, they do not adequately solve the problem addressed by the invention because they do not remain on the fibers long enough or reliably enough to initiate sensory effects thereon. This is only achieved with crystals which have a mean particle size of or below 6 μm, preferably 4 to 5 μm, the diameter being determined by light scattering or preferably by microscopy. Crystallization regulators which reliably guarantee this property of the preparations according to the invention are nonionic surfactants that are distinguished by an HLB value of or below 9 and preferably in the range from 4 to 6. Typical examples of crystallization regulators which satisfy this requirement are partial esters of $C_{12-22}$ fatty acids with glycerol, polyglycerol and/or sorbitan.

Partial Glycerides

Typical examples of suitable partial glycerides are hydroxystearic acid monoglyceride, hydroxystearic acid diglyceride, isostearic acid monoglyceride, isostearic acid diglyceride, oleic acid monoglyceride, oleic acid diglyceride, ricinoleic acid monoglyceride, ricinoleic acid diglyceride, linoleic acid monoglyceride, linoleic acid diglyceride, linolenic acid monoglyceride, linolenic acid diglyceride, erucic acid monoglyceride, erucic acid diglyceride, tartaric acid monoglyceride, tartaric acid diglyceride, citric acid monoglyceride, citric acid diglyceride, malic acid monoglyceride, malic acid diglyceride and technical mixtures thereof which may still contain small quantities of triglyceride from the production process.

Sorbitan Esters

Suitable sorbitan esters are sorbitan monoisostearate, sorbitan sesquiisostearate, sorbitan diisostearate, sorbitan triisostearate, sorbitan monooleate, sorbitan sesquioleate, sorbitan dioleate, sorbitan trioleate, sorbitan monoerucate, sorbitan sesquierucate, sorbitan dierucate, sorbitan trierucate, sorbitan monoricinoleate, sorbitan sesquiricinoleate, sorbitan diricinoleate, sorbitan triricinoleate, sorbitan monohydroxystearate, sorbitan sesquihydroxystearate, sorbitan dihydroxystearate, sorbitan trihydroxystearate, sorbitan monotartrate, sorbitan sesquitartrate, sorbitan ditartrate, sorbitan tritartrate, sorbitan monocitrate, sorbitan sesquicitrate, sorbitan dicitrate, sorbitan tricitrate, sorbitan monomaleate, sorbitan sesquimaleate, sorbitan dimaleate, sorbitan trimaleate and technical mixtures thereof.

Polyglycerol Esters

Typical examples of suitable polyglycerol esters are Polyglyceryl-2 Dipolyhydroxystearate (Dehymuls® PGPH), Polyglycerin-3-Diisostearate (Lameform® TGI), Polyglyceryl4 Isostearate (Isolan® GI 34), Polyglyceryl-3 Oleate, Diisostearoyl Polyglyceryl-3 Diisostearate (Isolan® PDI), Polyglyceryl-3 Methylglucose Distearate (Tego Care® 450), Polyglyceryl-3 Beeswax (Cera Bellina®), Polyglyceryl-4 Caprate (Polyglycerol Caprate T2010/90), Polyglyceryl-3 Cetyl Ether (Chimexane® NL), Polyglyceryl-3 Distearate (Cremophor® GS 32) and Polyglyceryl Polyricinoleate (Admul® WOL 1403), Polyglyceryl Dimerate Isostearate and mixtures thereof. Examples of other suitable polyolesters are the mono-, di- and triesters of trimethylol propane or pentaerythritol with lauric acid, cocofatty acid, tallow fatty acid, palmitic acid, stearic acid, oleic acid, behenic acid and the like optionally reacted with 1 to 30 mol ethylene oxide.

The preparations contain the crystallization regulators in quantities of typically 1 to 10 and more particularly 2 to 5% by weight.

Textile Finishing Preparations

In a preferred embodiment of the present invention, the textile finishing preparations contain (a) 15 to 30 and preferably 20 to 25% by weight of waxes with melting points of 35 to 60° C. and preferably 40 to 45° C. which contain a lipophilic wax matrix, (b) 10 to 20 and preferably 12 to 18% by weight of emulsifiers and (c) 1 to 10 and preferably 2 to 5% by weight crystallization regulators, with the proviso that the quantities shown add up to 100% by weight with water and typical auxiliaries and additives. The solids content is typically from 40 to 50% by weight and more particularly from 42 to 45% by weight. A combination of emulsifiers of the alkyl and/or alkenyl oligoglycoside type with crystallization regulators of the partial glyceride type has proved to be particularly advantageous. Among the waxes, glycol mono- and/or distearates are particularly suitable. Corresponding preparations are commercially available, for example, under the name of Lamesoft® FO (Cognis).

The present invention also relates to a process for finishing fibers, yarns and textile materials in which the fibers, yarns and textile materials are treated with an aqueous preparation containing (a) waxes with melting points of 35 to 60° C. and preferably 40 to 45° C. which contain a lipophilic wax matrix, (b) emulsifiers and (c) crystallization regulators and component (a) is then activated during wear by body heat or friction.

Commercial Applications

Finally, the present invention relates to the use of aqueous, aqueous/alcoholic or water-free preparations containing components (a), (b) and (c) for finishing fibers and textile surfaces. In the most simple case, the preparations may be directly used for this purpose. Normally, however, they form part of more complex formulations which may be, for example, heavy-duty or light-duty detergents, conditioners or softener concentrates, ironing aids, spray starches and the like. The percentage content of the mixtures according to the invention in these end products may vary considerably and is generally between 1 and 25, preferably between 5 and 20 and more particularly.

The preparations produced in this way may contain other typical auxiliaries and additives, for example anionic, nonionic, cationic, amphoteric or zwitterionic surfactants, builders, co-builders, oil- and fat-dissolving components, bleaching agents, bleach activators, redeposition inhibitors, enzymes, enzyme stabilizers, optical brighteners, polymers, defoamers, disintegrators, perfumes, inorganic salts, pigments and the like, as explained in more detail hereinafter.

Surfactants

So far as the choice of other anionic or nonionic surfactants, which be additionally present in the formulation, is concerned, reference is made to the foregoing observations. However, the combination of the preparations with cationic and amphoteric or zwitterionic surfactants is important, particularly when the fibers and textiles are to be finished by conditioning, i.e. by addition of a fabric softener.

Typical examples of cationic surfactants are, in particular, tetraalkylammonium compounds such as, for example, dimethyl distearyl ammonium chloride or Hydroxyethyl Hydroxycetyl Dimmonium Chloride (Dehyquart E) and esterquats. Estersquats are, for example, quaternized fatty acid triethanolamine ester salts corresponding to formula (III):

(III)

$$[R^3CO-(OCH_2CH_2)_{m1}OCH_2CH_2-\overset{\overset{R^5}{|}}{\underset{\underset{CH_2CH_2O(CH_2CH_2O)_{m3}R^6}{|}}{N^+}}-CH_2CH_2O-(CH_2CH_2O)_{m2}R^4]Y^-$$

in which $R^3CO$ is an acyl group containing 6 to 22 carbon atoms, $R^4$ and $R^5$ independently of one another represent hydrogen or have the same meaning as $R^3CO$, $R^4$ is an alkyl group containing 1 to 4 carbon atoms or a $(CH_2CH_2O)_{m4}H$ group, m1, m2 and m3 together stand for 0 or numbers of 1 to 12, m4 is a number of 1 to 12 and Y is halide, alkyl sulfate or alkyl phosphate. Typical examples of esterquats which may be used in accordance with the invention are products based on caproic acid, caprylic acid, capric acid, lauric acid, myristic acid, palmitic acid, isostearic acid, stearic acid, oleic acid, elaidic acid, arachic acid, behenic acid and erucic acid and the technical mixtures thereof obtained for example in the pressure hydrolysis of natural fats and oils. Technical $C_{12/18}$ cocofatty acids and, in particular, partly hydrogenated $C_{16/18}$ tallow or palm oil fatty acids and high-elaidic $C_{16/18}$ fatty acid cuts are preferably used. To produce the quaternized esters, the fatty acids and the triethanolamine may be used in a molar ratio of 1.1:1 to 3:1. With the performance properties of the esterquats in mind, a ratio of 1.2:1 to 2.2:1 and preferably 1.5:1 to 1.9:1 has proved to be particularly advantageous. The preferred esterquats are technical mixtures of mono-, di- and triesters with an average degree of esterification of 1.5 to 1.9 and are derived from technical $C_{16/18}$ tallow or palm oil fatty acid (iodine value 0 to 40). In performance terms, quaternized fatty acid triethanolamine ester salts corresponding to formula (III), in which $R^3CO$ is an acyl group containing 16 to 18 carbon atoms, $R^4$ has the same meaning as $R^3CO$, $R^4$ is hydrogen, $R^5$ is a methyl group, m1, m2 and m3 stand for 0 and Y stands for methyl sulfate, have proved to be particularly advantageous.

Other suitable esterquats besides the quaternized fatty acid triethanolamine ester salts are quaternized ester salts of fatty acids with diethanolalkyamines corresponding to formula (IV):

(IV)

$$[R^7CO-(OCH_2CH_2)_{m5}OCH_2CH_2-\overset{\overset{R^9}{|}}{\underset{\underset{R^{10}}{|}}{N^+}}-CH_2CH_2O-(CH_2CH_2O)_{m6}R^8]Y^-$$

in which $R^7CO$ is an acyl group containing 6 to 22 carbon atoms, $R^8$ is hydrogen or has the same meaning as $R^7CO$, $R^9$ and $R^{10}$ independently of one another are alkyl groups containing 1 to 4 carbon atoms, m5 and m6 together stand for 0 or numbers of 1 to 12 and Y stands for halide, alkyl sulfate or alkyl phosphate.

Finally, another group of suitable esterquats are the quaternized ester salts of fatty acids with 1,2-dihydroxypropyl dialkylamines corresponding to formula (V):

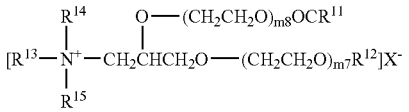

(V)

in which $R^1CO$ is an acyl group containing 6 to 22 carbon atoms, $R^{12}$ is hydrogen or has the same meaning as $R^{11}CO$, $R^{13}$, $R^{14}$ and $R^{15}$ independently of one another are alkyl groups containing 1 to 4 carbon atoms, m7 and m8 together stand for 0 or numbers of 1 to 12 and X stands for halide, alkyl sulfate or alkyl phosphate. Finally, other suitable esterquats are substances in which the ester bond is replaced by an amide bond and which—preferably based on diethylenetriamine—correspond to formula (VI):

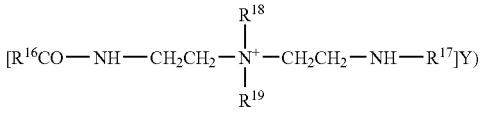

(VI)

in which $R^{16}CO$ is an acyl group containing 6 to 22 carbon atoms, $R^{17}$ is hydrogen or has the same meaning as $R^{16}CO$, $R^{17}$ and $R^{18}$ independently of one another are alkyl groups containing 1 to 4 carbon atoms and Y is halide, alkyl sulfate or alkyl phosphate. Amide esterquats such as these are commercially obtainable, for example, under the name of Incroquat® (Croda).

Examples of suitable amphoteric or zwitterionic surfactants are alkyl betaines, alkyl amidobetaines, aminopropionates, aminoglycinates, imidazolinium betaines and sulfobetaines. Examples of suitable alkyl betaines are the carboxyalkylation products of secondary and, in particular, tertiary amines such as, for example, carboxymethylation products of hexylmethyl amine, hexyldimethyl amine, octyidimethyl amine, decyldimethyl amine, dodecylmethyl amine, dodecyldimethyl amine, dodecylethylmethyl amine, $C_{12/14}$ cocoalkyldimethyl amine, myristyldimethyl amine, cetyldimethyl amine, stearyidimethyl amine, stearylethylmethyl amine, oleyldimethyl amine, $C_{16/18}$ tallow alkyldimethyl amine and technical mixtures thereof.

Also suitable are carboxyalkylation products of amidoamines, for example reaction products of fatty acids containing 6 to 22 carbon atoms, namely caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof, with N,N-dimethylaminoethyl amine, N,N-dimethyl-aminopropyl amine, N,N-diethylaminoethyl amine and N,N-diethylaminopropyl amine which are condensed with sodium chloroacetate. A condensation product of $C_{8/18}$-cocofatty acid-N,N-dimethylaminopropyl amide with sodium chloroacetate is preferably used. Imidazolinium betaines may also be used. These compounds are also known compounds which may be obtained, for example, by cyclizing condensation of 1 or 2 mol fatty acid with polyfunctional amines such as, for example, aminoethyl ethanolamine, (AEEA) or diethylenetriamine. The corresponding carboxyalkylation products are mixtures of different open-chain betaines. Typical examples are condensation products of the fatty acids mentioned above with AEEA, preferably imidazolines based on lauric acid or—again—$C_{12/14}$ cocofatty acid which are subsequently betainized with sodium chloroacetate.

Builders

The laundry detergents, dishwashing detergents, cleaning compositions and conditioners according to the invention may also contain additional inorganic and organic builders, for example in quantities of 10 to 50 and preferably 15 to 35% by weight, based on the particular product, suitable inorganic builders mainly being zeolites, crystalline layer silicates, amorphous silicates and—where permitted—also phosphates such as, for example, tripolyphosphate. The quantity of co-builder should be included in the preferred quantities of phosphates.

Zeolites

The finely crystalline, synthetic zeolite containing bound water often used as a detergent builder is preferably zeolite A and/or zeolite P. Zeolite MAP® (Crosfield) is a particularly preferred P-type zeolite. However, zeolite X and mixtures of A, X and/or P and also Y are also suitable. A co-crystallized sodium/potassium aluminium silicate of zeolite A and zeolite X commercially available as VEGOBOND AX® (from Condea Augusta S.p.A.) is also of particular interest. The zeolite may be used in the form of a spray-dried powder or even in the form of an undried stabilized suspension still moist from its production. Where the zeolite is used in the form of a suspension, the suspension may contain small additions of nonionic surfactants as stabilizers, for example 1 to 3% by weight, based on zeolite, of ethoxylated $C_{12-18}$ fatty alcohols containing 2 to 5 ethylene oxide groups, $C_{12-14}$ fatty alcohols containing 4 to 5 ethylene oxide groups or ethoxylated isotridecanols. Suitable zeolites have a mean particle size of less than 10 μm (volume distribution, as measured by the Coulter Counter method) and contain preferably 18 to 22% by weight and more preferably 20 to 22% by weight of bound water.

Layer Silicates

Suitable substitutes or partial substitutes for phosphates and zeolites are crystalline layer sodium silicates corresponding to the general formula $NaMSi_xO_{2x+1}AyH_2O$, where M is sodium or hydrogen, x is a number of 1.9 to 4 and y is a number of 0 to 20, preferred values for x being 2, 3 or 4. Preferred crystalline layer silicates corresponding to the above formula are those in which M is sodium and x assumes the value 2 or 3. Both β- and δ-sodium disilicates $Na_2Si_2O_5.yH_2O$ are particularly preferred. The suitability of these layer silicates is not limited to a particular composition or structural formula. However, smectites, more especially bentonites, are preferred for the purposes of the present invention. Suitable layer silicates which belong to the group of water-swellable smectites are, for example, those corresponding to the following general formulae:

$(OH)_4Si_{8-y}Al_y(Mg_xAl_{4-x})O_{20}$ montmorillonite $(OH)_4Si_{8-y}Al_y(Mg_{6-z}Li_z)O_{20}$ hectorite $(OH)_4Si_{8-y}Al_y(Mg_{6-z}Al_z)O_{20}$ saponite where x=0 to 4, y=0 to 2 and z=0 to 6. Small amounts of iron may additionally be incorporated in the crystal lattice of the layer silicates corresponding to the above formulae. In addition, by virtue of their ion-exchanging properties, the layer silicates may contain hydrogen, alkali metal and alkaline-earth metal ions, more particularly $Na^+$ and $Ca^{2+}$. The quantity of water of hydration is generally in the range from 8 to 20% by weight and is dependent upon the degree of swelling or upon the treatment method. Layer silicates which, by virtue of an alkali treatment, are largely free from calcium ions and strongly colouring iron ions are preferably used.

Other preferred builders are amorphous sodium silicates with a modulus ($Na_2O:SiO_2$ ratio) of 1:2 to 1:3.3, preferably 1:2 to 1:2.8 and more preferably 1:2 to 1:2.6 which dissolve with delay and exhibit multiple wash cycle properties. The delay in dissolution in relation to conventional amorphous sodium silicates can have been obtained in various ways, for example by surface treatment, compounding, compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. Particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. Compacted amorphous silicates, compounded amorphous silicates and overdried X-ray-amorphous silicates are particularly preferred.

Phosphates

The generally known phosphates may of course also be used as builders providing their use should not be avoided on ecological grounds. The sodium salts of the orthophosphates, the pyrophosphates and, in particular, the tripolyphosphates are particularly suitable. Their content is generally no more than 25% by weight and preferably no more than 20% by weight, based on the final composition. In some cases, it has been found that, in combination with other builders, tripolyphosphates in particular produce a synergistic improvement in multiple wash cycle performance, even in small quantities of up to at most 10% by weight, based on the final composition.

Co-builders

Useful organic builders suitable as co-builders are, for example, the polycarboxylic acids usable in the form of their sodium salts, such as citric acid, adipic acid, succinic acid, glutaric acid, tartaric acid, sugar acids, aminocarboxylic acids, nitrilotriacetic acid (NTA), providing its use is not ecologically unsafe, and mixtures thereof. Preferred salts are the salts of the polycarboxylic acids, such as citric acid, adipic acid, succinic acid, glutaric acid, tartaric acid, sugar acids and mixtures thereof. The acids per se may also be used. Besides their building effect, the acids also typically have the property of an acidifying component and, hence, also serve to establish a relatively low and mild pH value in detergents or cleaners. Citric acid, succinic acid, glutaric acid, adipic acid, gluconic acid and mixtures thereof are particularly mentioned in this regard.

Dextrins

Other suitable organic builders are dextrins, for example oligomers or polymers of carbohydrates which may be obtained by partial hydrolysis of starches. The hydrolysis may be carried out by standard methods, for example acid- or enzyme-catalyzed methods. The end products are preferably hydrolysis products with average molecular weights of 400 to 500,000. A polysaccharide with a dextrose equivalent (DE) of 0.5 to 40 and, more particularly, 2 to 30 is preferred, the DE being an accepted measure of the reducing effect of a polysaccharide by comparison with dextrose which has a DE of 100. Both maltodextrins with a DE of 3 to 20 and dry glucose syrups with a DE of 20 to 37 and also so-called yellow dextrins and white dextrins with relatively high molecular weights of 2,000 to 30,000 may be used. The oxidized derivatives of such dextrins are their reaction products with oxidizing agents which are capable of oxidizing at least one alcohol function of the saccharide ring to the carboxylic acid function.

Succinates

Other suitable co-builders are oxydisuccinates and other derivatives of disuccinates, preferably ethylenediamine disuccinate. Glycerol disuccinates and glycerol trisuccinates are also particularly preferred in this connection. The quantities used in zeolite-containing and/or silicate-containing formulations are from 3 to 15% by weight. Other useful organic co-builders are, for example, acetylated hydroxycarboxylic acids and salts thereof which may optionally be present in lactone form and which contain at least 4 carbon atoms, at least one hydroxy group and at most two acid groups.

Polycarboxylates

Suitable polymeric polycarboxylates are, for example, the sodium salts of polyacrylic acid or polymethacrylic acid, for example those with a relative molecular weight of 800 to 150,000 (based on acid and measured against polystyrenesulfonic acid). Suitable copolymeric polycarboxylates are, in particular, those of acrylic acid with methacrylic acid and of acrylic acid or methacrylic acid with maleic acid. Acrylic acid/maleic acid copolymers containing 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000 (as measured against polystyrenesulfonic acid). The (co)polymeric polycarboxylates may be used either as powders or as aqueous solutions, 20 to 55% by weight aqueous solutions being preferred. Granular polymers are generally added to basic granules of one or more types in a subsequent step. Also particularly preferred are biodegradable polymers of more than two different monomer units. Other preferred builders are polymeric aminodicarboxylic acids, salts and precursors thereof. Polyaspartic acids and salts and derivatives thereof are particularly preferred.

Polyacetals

Other suitable builders are polyacetals which may be obtained by reaction of dialdehydes with polyol carboxylic acids containing 5 to 7 carbon atoms and at least three hydroxyl groups. Preferred polyacetals are obtained from dialdehydes, such as glyoxal, glutaraldehyde, terephthalaldehyde and mixtures thereof and from polyol carboxylic acids, such as gluconic acid and/or glucoheptonic acid.

Oil- and Fat-Dissolving Substances

In addition, the compositions may contain components with a positive effect on the removability of oil and fats from textiles by washing. Preferred oil- and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. Of these, the sulfonated derivatives of phthalic acid and terephthalic acid polymers are particularly preferred.

Bleaching Agents and Bleach Activators

Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloiminoper acid or diperdodecanedioic acid. The content of peroxy bleaching agents in the preparations is preferably 5 to 35% by weight and more preferably up to 30% by weight, perborate monohydrate or percarbonate advantageously being used.

Suitable bleach activators are compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O— and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl or isononanoyloxybenzenesulfonate (n- or iso-NOBS), carboxylic anhydrides, more particularly phthalic anhydride, acylated polyhydric alcohols, more particularly triacetin, ethylene glycol diacetate, 2,5-diacetoxy-2,5-dihydrofuran, enol esters and acetylated sorbitol and mannitol and acylated sugar derivatives thereof, more particularly pentaacetyl glucose (PAG), pentaacetyl fructose, tetraacetyl xylose and octaacetyl lactose, and acetylated, optionally N-alkylated glucamine and gluconolactone, and/or N-acylated lactams, for example N-benzoyl caprolactam. Bleach activators such as these are present in the usual quantities, preferably in quantities of 1% by weight to 10% by weight and more preferably in quantities of 2% by weight to 8% by weight, based on the preparation as a whole. In addition to or instead of the conventional bleach activators mentioned above, sulfonimines and/or bleach-boosting transition metal salts or transition metal complexes may also be present as so-called bleach catalysts. Suitable transition metal compounds include, in particular, manganese-, iron-, cobalt-, ruthenium- or molybdenum-salen complexes and N-analog compounds thereof, manganese-, iron-, cobalt-, ruthenium- or molybdenum-carbonyl complexes, manganese, iron, cobalt, ruthenium, molybdenum, titanium, vanadium and copper complexes with nitrogen-containing tripod ligands and cobalt-, iron-, copper- and ruthenium-ammine complexes. Bleach-boosting transition metal complexes, more particularly with the central atoms Mn, Fe, Co. Cu, Mo, V, Ti and/or Ru, are used in typical quantities, preferably in a quantity of up to 1% by weight, more preferably in a quantity of 0.0025% by weight to 0.25% by weight and most preferably in a quantity of 0.01% by weight to 0.1% by weight, based on the detergent/cleaning composition as a whole.

Enzymes and Enzyme Stabilizers

Suitable enzymes are, in particular, enzymes from the class of hydrolases, such as proteases, esterases, lipases or lipolytic enzymes, amylases, cellulases or other glycosyl hydrolases and mixtures thereof. All these hydrolases contribute to the removal of stains, such as protein-containing, fat-containing or starch-containing stains, and discolouration in the washing process. Cellulases and other glycosyl hydrolases can contribute towards colour retention and towards increasing fabric softness by removing pilling and microfibrils. Oxidoreductases may also be used for bleaching and for inhibiting dye transfer. Enzymes obtained from bacterial strains or fungi, such as *Bacillus subtilis, Bacillus licheniformis, Streptomyces griseus* and *Humicola insolens* are particularly suitable. Proteases of the subtilisin type are preferably used, proteases obtained from *Bacillus lentus* being particularly preferred. Of particular interest in this regard are enzyme mixtures, for example of protease and amylase or protease and lipase or lipolytic enzymes or protease and cellulase or of cellulase and lipase or lipolytic enzymes or of protease, amylase and lipase or lipolytic enzymes or protease, lipase or lipolytic enzymes and cellulase, but especially protease- and/or lipase-containing mixtures or mixtures with lipolytic enzymes. Examples of such lipolytic enzymes are the known cutinases. Peroxidases or oxidases have also been successfully used in some cases. Suitable amylases include in particular α-amylases, isoamylases, pullanases and pectinases. Preferred cellulases are cellobio-hydrolases, endoglucanases and β-glucosidases, which are also known as cellobiases, and mixtures thereof. Since the various cellulase types differ in their CMCase and avicelase activities, the desired activities can be established by mixing the cellulases in the appropriate ratios.

The enzymes may be adsorbed to supports and/or encapsulated in membrane materials to protect them against premature decomposition. The percentage content of enzymes, enzyme mixtures or enzyme granules may be, for example, about 0.1 to 5% by weight and is preferably from 0.1 to about 2% by weight.

In addition to the monohydric and polyhydric alcohols, the compositions may contain other enzyme stabilizers. For example, 0.5 to 1% by weight of sodium formate may be used. Proteases stabilized with soluble calcium salts and having a calcium content of preferably about 1.2% by weight, based on the enzyme, may also be used. Apart from calcium salts, magnesium salts also serve as stabilizers. However, it is of particular advantage to use boron compounds, for example boric acid, boron oxide, borax and other alkali metal borates, such as the salts of orthoboric acid ($H_3BO_3$), metaboric acid ($HBO_2$) and pyroboric acid (tetraboric acid $H_2B_4O_7$).

Redeposition Inhibitors

The function of redeposition inhibitors is to keep the soil detached from the fibers suspended in the wash liquor and thus to prevent the soil from being re-absorbed by the washing. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (sodium salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone are also preferably used, for example in quantities of 0.1 to 5% by weight, based on the preparation.

Optical Brighteners

The preparations may contain derivatives of diaminostilbene disulfonic acid or alkali metal salts thereof as optical brighteners. Suitable optical brighteners are, for example, salts of 4,4'-bis-(2-anilino4-morpholino-1,3,5-triazinyl-6-amino)-stilbene-2,2'-disulfonic acid or compounds of similar structure which contain a diethanolamino group, a methylamino group and anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)4'-(2-sulfostyryl)-diphenyl, may also be present. Mixtures of the brighteners mentioned may also be used. Uniformly white granules are obtained if, in addition to the usual brighteners in the usual quantities, for example between 0.1 and 0.5% by weight and preferably between 0.1 and 0.3% by weight, the preparations also contain small quantities, for example $10^{-6}$ to $10^{-3}$% by weight and preferably around $10^{-5}$% by weight, of a blue dye. A particularly preferred dye is Tinolux® (a product of Ciba-Geigy).

Polymers

Suitable soil repellents are substances which preferably contain ethylene terephthalate and/or polyethylene glycol terephthalate groups, the molar ratio of ethylene terephthalate to polyethylene glycol terephthalate being in the range from 50:50 to 90:10. The molecular weight of the linking polyethylene glycol units is more particularly in the range from 750 to 5,000, i.e. the degree of ethoxylation of the polymers containing poly-ethylene glycol groups may be about 15 to 100. The polymers are distinguished by an average molecular weight of about 5,000 to 200,000 and may have a block structure, but preferably have a random structure. Preferred polymers are those with molar ethylene terephthalate: polyethylene glycol terephthalate ratios of about 65:35 to about 90:10 and preferably in the range from about 70:30 to 80:20. Other preferred polymers are those which contain linking polyethylene glycol units with a molecular weight of 750 to 5,000 and preferably in the range from 1,000 to about 3,000 and which have a molecular weight of the polymer of about 10,000 to about 50,000. Examples of commercially available polymers are the products Milease® T (ICI) or Repelotex® SRP 3 (Rhône-Poulenc).

Defoamers

Wax-like compounds may be used as defoamers in accordance with the present invention. "Wax-like" compounds are understood to be compounds which have a melting point at atmospheric pressure above 25° C. (room temperature), preferably above 50° C. and more preferably above 70° C. The wax-like defoamers are substantially insoluble in water, i.e. their solubility in 100 g of water at 20° C. is less than 0.1% by weight. In principle, any wax-like defoamers known from the prior art may additionally be present. Suitable wax-like compounds are, for example, bisamides, fatty alcohols, fatty acids, carboxylic acid esters of monohydric and polyhydric alcohols and paraffin waxes or mixtures thereof. Alternatively, the silicone compounds known for this purpose may of course also be used.

Paraffin Waxes

Suitable paraffin waxes are generally a complex mixture with no clearly defined melting point. For characterization, its melting range is normally determined by differential thermoanalysis (DTA) and/or its solidification point is determined. The solidification point is understood to be the temperature at which the paraffin changes from the liquid state into the solid state by slow cooling. Paraffins which are entirely liquid at room temperature, i.e. paraffins with a solidification point below 25° C., are not suitable for use in accordance with the invention. Soft waxes which have a melting point of 35 to 50° C. preferably include the group of petrolates and hydrogenation products thereof. They are composed of microcrystalline paraffins and up to 70% by weight of oil, have an ointment-like to plastic, firm consistency and represent bitumen-free residues from the processing of petroleum. Distillation residues (petrolatum stock) of certain paraffin-based and mixed-base crude oils further processed to Vaseline are particularly preferred. Bitumen-free oil-like to solid hydrocarbons separated from distillation residues of paraffin-based or mixed-base crude oil and cylinder oil distillates are also preferred. They are of semisolid, smooth, tacky to plastic and firm consistency and have melting points of 50 to 70° C. These petrolates are the most important starting materials for the production of microwaxes. The solid hydrocarbons with melting points of 63 to 79° C. separated from high-viscosity, paraffin-containing lubricating oil distillates during deparaffinization are also suitable. These petrolates are mixtures of microcrystalline waxes and high-melting n-paraffins. It is possible, for example, to use paraffin wax mixtures of, for example, 26% by weight to 49% by weight of microcrystalline paraffin wax with a solidification point of 62° C. to 90° C., 20% by weight to 49% by weight of hard paraffin with a solidification point of 42° C. to 56° C. and 2% by weight to 25% by weight of soft paraffin with a solidification point of 35° C. to 40° C. Paraffins or paraffin mixtures which solidify at temperatures of 30° C. to 90° C. are preferably used. It is important in this connection to bear in mind that even paraffin wax mixtures which appear solid at room temperature may contain different amounts of liquid paraffin. In the paraffin waxes suitable for use in accordance with the invention, this liquid component is as small as possible and is preferably absent altogether. Thus, particularly preferred paraffin wax mixtures have a liquid component at 30° C. of less than 10% by weight and, more particularly, from 2% by weight to 5% by weight, a liquid component at 40° C. of less than 30% by weight, preferably from 5% by weight to 25% by weight and more preferably from 5% by weight to 15% by weight, a liquid component at 60° C. of 30% by weight to 60% by weight and preferably 40% by weight to 55% by weight, a liquid component at 80° C. of 80% by weight to 100% by weight and a liquid component at 90° C. of 100% by weight. In particularly preferred paraffin wax mixtures, the temperature at which a liquid component of 100% by weight of the paraffin wax is reached is still below 85° C. and, more particularly, between 75° C. and 82° C. The paraffin waxes may be petrolatum, microcrystalline waxes or hydrogenated or partly hydrogenated paraffin waxes.

Bisamides

Bisamides suitable as defoamers are those derived from saturated fatty acids containing 12 to 22 and preferably 14 to 18 carbon atoms and from alkylenediamines containing 2 to 7 carbon atoms. Suitable fatty acids are lauric acid, myristic acid, stearic acid, arachic acid and behenic acid and the mixtures thereof obtainable from natural fats or hydrogenated oils, such as tallow or hydrogenated palm oil. Suitable diamines are, for example, ethylenediamine, 1,3-propylenediamine, tetramethylenediamine, pentamethylenediamine, hexamethylenediamine, p-phenylenediamine and toluylenediamine. Preferred diamines are ethylenediamine and hexamethylenediamine. Particularly preferred bisamides are bis-myristoyl ethylenediamine, bis-palmitoyl ethylenediamine, bis-stearoyl ethylenediamine and mixtures thereof and the corresponding derivatives of hexamethylenediamine.

Carboxylic Acid Esters

Suitable carboxylic acid esters as defoamers are derived from carboxylic acids containing 12 to 28 carbon atoms. The esters in question are, in particular, esters of behenic acid, stearic acid, hydroxystearic acid, oleic acid, palmitic acid, myristic acid and/or lauric acid. The alcohol moiety of the carboxylic acid ester contains a monohydric or polyhydric alcohol containing 1 to 28 carbon atoms in the hydrocarbon chain. Examples of suitable alcohols are behenyl alcohol, arachidyl alcohol, cocoalcohol, 12-hydroxystearyl alcohol, oleyl alcohol and lauryl alcohol and ethylene glycol, glycerol, polyvinylvinyl alcohol, sucrose, erythritol, pentaerythritol, sorbitan and/or sorbitol. Preferred esters are esters of methanol, ethylene glycol, glycerol and sorbitan, the acid moiety of the ester being selected in particular from behenic acid, stearic acid, oleic acid, palmitic acid or myristic acid. Suitable esters of polyhydric alcohols are, for example, xylitol monopalmitate, pentaerythritol mono-stearate, glycerol monostearate, ethylene glycol monostearate and sorbitan monostearate, sorbitan palmitate, sorbitan monolaurate, sorbitan dilaurate, sorbitan distearate, sorbitan dibehenate, sorbitan dioleate and mixed tallow alkyl sorbitan monoesters and diesters. Suitable glycerol esters are the mono-, di- or triesters of glycerol and the carboxylic acids mentioned, the monoesters and diesters being preferred. Glycerol monostearate, glycerol monooleate, glycerol monopalmitate, glycerol monobehenate and glycerol distearate are examples. Examples of suitable natural esters as defoamers are beeswax, which mainly consists of the esters $CH_3(CH_2)_{24}COO(CH_2)_{27}CH_3$ and $CH_3(CH_2)_{26}COO(CH_2)_{25}CH_3$, and carnauba wax, carnauba wax being a mixture of carnauba acid alkyl esters, often in combination with small amounts of free carnauba acid, other long-chain acids, high molecular weight alcohols and hydrocarbons.

Carboxylic Acids

Suitable carboxylic acids as another defoamer compound are, in particular, behenic acid, stearic acid, oleic acid, palmitic acid, myristic acid and lauric acid and the mixtures thereof obtainable from natural fats or optionally hydrogenated oils, such as tallow or hydrogenated palm oil. Saturated fatty acids containing 12 to 22 and, more particularly, 18 to 22 carbon atoms are preferred. The corresponding fatty alcohols with the same C chain length may also be used, Dialkyl Ethers and Ketones Dialkyl ethers may also be present as defoamers. The ethers may have an asymmetrical or symmetrical structure, i.e. they may contain two identical or different alkyl chains, preferably containing 8 to 18 carbon atoms. Typical examples are di-n-octyl ether, di-i-octyl ether and di-n-stearyl ether, dialkyl ethers with a melting point above 25° C. and more particularly above 40° C. being particularly suitable. Other suitable defoamer compounds are fatty ketones which may be obtained by the relevant methods of preparative organic chemistry. They are produced, for example, from carboxylic acid magnesium salts which are pyrolyzed at temperatures above 300° C. with elimination of carbon dioxide and water. Suitable fatty ketones are produced by pyrolysis of the magnesium salts of lauric acid, myristic acid, palmitic aid, palmitoleic acid, stearic acid, oleic acid, elaidic acid, petroselic acid, arachic acid, gadoleic acid, behenic acid or erucic acid.

Fatty Acid Polyethylene Glycol Esters

Other suitable defoamers are fatty acid polyethylene glycol esters which are preferably obtained by the homogeneously base-catalyzed addition of ethylene oxide onto fatty acids. The addition of ethylene oxide onto the fatty acids takes place in particular in the presence of alkanolamines as catalysts. The use of alkanolamines, especially triethanolamine, leads to extremely selective ethoxylation of the fatty acids, particularly where it is desired to produce compounds with a low degree of ethoxylation. Within the group of fatty acid polyethylene glycol esters, those with a melting point above 25° C. and more particularly above 40° C. are preferred.

Silicones

Suitable silicones in the context of the present invention are typical organopolysiloxanes containing fine-particle silica which, in turn, may even be silanized. Polydiorganosiloxanes and, in particular, polydimethylsiloxanes known from the prior art are particularly preferred. Suitable polydiorganosiloxanes have a substantially linear chain and a degree of oligomerization of 40 to 1,500. Examples of suitable substituents are methyl, ethyl, propyl, isobutyl, tert. butyl and phenyl. Amino-, fatty-acid-, alcohol-, polyether-, epoxy-, fluorine-, glycoside- and/or alkyl-modified silicone compounds which may be both liquid and resin-like at room temperature are also suitable, as are simethicones, i.e. mixtures of dimethicones with an average chain length of 200 to 300 dimethyl siloxane units and hydrogenated silicates. Normally, the silicones in general and the polydiorganosiloxanes in particular contain fine-particle silica which may even be silanized. Silica-containing dimethyl polysiloxanes are particularly suitable for the purposes of the invention. The polydiorganosiloxanes advantageously have a Brookfield viscosity at 25° C. (spindle 1, 10 r.p.m.) of 5,000 mPas to 30,000 mPas and, more particularly, 15,000 mPas to 25,000 mPas. The silicones are preferably used in the form of aqueous emulsions. The silicone is generally added with stirring to water. If desired, thickeners known from the prior art may be added to the aqueous silicone emulsions to increase their viscosity. These known thickeners may be inorganic and/or organic materials, particularly preferred thickeners being nonionic cellulose ethers, such as methyl cellulose, ethyl cellulose and mixed ethers, such as methyl hydroxyethyl cellulose, methyl hydroxypropyl cellulose, methyl hydroxybutyl cellulose and anionic carboxycellulose types, such as carboxymethyl cellulose sodium salt (CMC). Particularly suitable thickeners are mixtures of CMC and nonionic cellulose ethers in a ratio by weight of 80:20 to 40:60 and more particularly 75:25 to 60:40. In general, concentrations of ca. 0.5 to 10 and more particularly 2.0 to 6% by weight—expressed as thickener mixture and based on aqueous silicone emulsion—are recommended, particularly where the described thickener mixtures are added. The content of silicones of the described type in the aqueous emulsions is advantageously in the range from 5 to 50% by weight and more particularly in the range from 20 to 40% by weight, expressed as silicone and based on aqueous emulsion. In another advantageous embodiment, the aqueous silicone solutions contain starch from natural sources, for example from rice, potatoes, corn and wheat, as thickener. The starch is advantageously present in quantities of 0.1 to 50% by weight, based on silicone emulsion, and more particularly in admixture with the already described thickeners of sodium carboxymethyl cellulose and a nonionic cellulose ether in the quantities already mentioned. The aqueous silicone emulsions are preferably prepared by preswelling the thickeners present, if any, before adding the silicones. The silicones are preferably incorporated using effective mixers and stirrers.

Within the group of wax-like defoamers, the described paraffin waxes—in a particularly preferred embodiment—are used either on their own as wax-like defoamers or in admixture with one of the other wax-like defoamers, the percentage content of the paraffin waxes in the mixture preferably exceeding 50% by weight, based on the wax-like defoamer mixture. If necessary, the paraffin waxes may be applied to supports. Suitable support materials in the context of the present invention are any known inorganic and/or organic support materials. Examples of typical inorganic support materials are alkali metal carbonates, alumosilicates, water-soluble layer silicates, alkali metal silicates, alkali metal sulfates, for example sodium sulfate, and alkali metal phosphates. The alkali metal silicates are preferably a compound with a molar ratio of alkali metal oxide to $SiO_2$ of 1:1.5 to 1:3.5. The use of silicates such as these results in particularly good particle properties, more particularly high abrasion resistance and at the same time a high dissolving rate in water. Alumosilicates as a support material include, in particular, the zeolites, for example zeolite NaA and NaX. The compounds described as water-soluble layer silicates include, for example, amorphous or crystalline waterglass. Silicates commercially available as Aerosil® or Sipernat® may also be used. Suitable organic carrier materials are, for example, film-forming polymers, for example polyvinyl alcohols, polyvinyl pyrrolidones, poly(meth)acrylates, polycarboxylates, cellulose derivatives and starch. Suitable cellulose ethers are, in particular, alkali metal carboxymethyl cellulose, methyl cellulose, ethyl cellulose, hydroxyethyl cellulose and so-called cellulose mixed ethers, for example methyl hydroxyethyl cellulose and methyl hydroxypropyl cellulose, and mixtures thereof. Particularly suitable mixtures are mixtures of sodium carboxymethyl cellulose and methyl cellulose, the carboxymethyl cellulose normally having a degree of substitution of 0.5 to 0.8 carboxymethyl groups per anhydroglucose unit while the methyl cellulose has a degree of substitution of 1.2 to 2 methyl groups per anhydroglucose unit. The mixtures preferably contain alkali metal carboxymethyl cellulose and nonionic cellulose ether in ratios by weight of 80:20 to 40:60 and, more particularly, 75:25 to 50:50. Another suitable support is native starch which is made up of amylose and amylopectin. Native starch is starch obtainable as an extract from natural sources, for example from rice, potatoes, corn and wheat. Native starch is a standard commercial product and is therefore readily available. Suitable support materials are individual compounds or several of the compounds mentioned above selected in particular from the group of alkali metal carbonates, alkali metal sulfates, alkali metal phosphates, zeolites, water-soluble layer silicates, alkali metal silicates, polycarboxylates, cellulose ethers, polyacrylate/polymethacrylate and starch. Mixtures of alkali metal carbonates, more particularly sodium carbonate, alkali metal silicates, more particularly sodium silicate, alkali metal sulfates, more particularly sodium sulfate, and zeolites are particularly suitable.

Disintegrators

The solid preparations may additionally contain disintegrators. Disintegrators are substances which are added to the shaped bodies to accelerate their disintegration on contact with water. These substances are capable of undergoing an increase in volume on contact with water so that, on the one hand, their own volume is increased (swelling) and, on the other hand, a pressure can be generated through the release of gases which causes the tablet to disintegrate into relatively small particles. Well-known disintegrators are, for example, carbonate/citric acid systems, although other organic acids may also be used. Swelling disintegration aids are, for example, synthetic polymers, such as polyvinyl pyrrolidone (PVP), or natural polymers and modified natural substances, such as cellulose and starch and derivatives thereof, alginates or casein derivatives. According to the invention, preferred disintegrators are cellulose-based disintegrators. Pure cellulose has the formal empirical composition $(C_6H_{10}O_5)_n$ and, formally, is a β-1,4-polyacetal of cellobiose which, in turn, is made up of two molecules of glucose. Suitable celluloses consist of ca. 500 to 5,000 glucose units and, accordingly, have average molecular weights of 50,000 to 500,000. According to the invention, cellulose derivatives obtainable from cellulose by polymer-analog reactions may also be used as cellulose-based disintegrators. These chemically modified celluloses include, for example, products of esterification or etherification reactions in which hydroxy hydrogen atoms have been substituted. However, celluloses in which the hydroxy groups have been replaced by functional groups that are not attached by an oxygen atom may also be used as cellulose derivatives. The group of cellulose derivatives includes, for example, alkali metal celluloses, carboxymethyl cellulose (CMC), cellulose esters and ethers and aminocelluloses. The cellulose derivatives mentioned are preferably not used on their own, but rather in the form of a mixture with cellulose as cellulose-based disintegrators. The content of cellulose derivatives in mixtures such as these is preferably below 50% by weight and more preferably below 20% by weight, based on the cellulose-based disintegrator. In one particularly preferred embodiment, pure cellulose free from cellulose derivatives is used as the cellulose-based disintegrator. Microcrystalline cellulose may be used as another cellulose-based disintegration aid or as part of such a component. This microcrystalline cellulose is obtained by partial hydrolysis of celluloses under conditions which only attack and completely dissolve the amorphous regions (ca. 30% of the total cellulose mass) of the celluloses, but leave the crystalline regions (ca. 70%) undamaged. Subsequent de-aggregation of the microfine celluloses formed by hydrolysis provides the microcrystalline celluloses which have primary particle sizes of ca. 5 μm and which can be compacted, for example, to granules with a mean particle size of 200 μm. Viewed macroscopically, the disintegrators may be homogeneously distributed in the granules although, when observed under a microscope, they form zones of increased concentration due to their production. Disintegrators which may be present in accordance with the invention such as, for example, Kollidon, alginic acid and alkali metal salts thereof, amorphous or even partly crystalline layer silicates (bentonites), polyacrylates, polyethylene glycols. The preparations may contain the disintegrators in quantities of 0.1 to 25% by weight, preferably 1 to 20% by weight and more particularly 5 to 15% by weight, based on the shaped bodies.

Perfumes

Suitable perfume oils or perfumes include individual perfume compounds, for example synthetic products of the ester, ether, aldehyde, ketone, alcohol and hydrocarbon type. Perfume compounds of the ester type are, for example, benzyl acetate, phenoxyethyl isobutyrate, p-tert.butyl cyclohexyl acetate, linalyl acetate, dimethyl benzyl carbinyl acetate, phenyl ethyl acetate, linalyl benzoate, benzyl formate, ethyl methyl phenyl glycinate, allyl cyclohexyl propionate, styrallyl propionate and benzyl salicylate. The ethers include, for example, benzyl ethyl ether; the aldehydes include, for example, the linear alkanals containing 8 to 18 carbon atoms, citral, citronellal, citronellyloxyacetaldehyde, cyclamen aldehyde, hydroxycitronellal, lilial and bourgeonal; the ketones include, for example, the ionones, α-isomethyl ionone and methyl cedryl ketone; the alcohols include anethol, citronellol, eugenol, geraniol, linalool, phenyl ethyl alcohol and terpineol and the hydrocarbons include, above all, the terpenes, such as limonene and pinene. However, mixtures of various perfumes which together produce an attractive perfume note are preferably used. Perfume oils such as these may also contain natural perfume mixtures obtainable from vegetable sources, for example pine, citrus, jasmine, patchouli, rose or ylang-ylang oil. Also suitable are clary oil, camomile oil, clove oil, melissa oil, mint oil, cinnamon leaf oil, lime blossom oil, juniper berry oil, vetiver oil, olibanum oil, galbanum oil and ladanum oil and orange blossom oil, neroli oil, orange peel oil and sandalwood oil. The perfumes may be directly incorporated in the preparations according to the invention, although it can also be of advantage to apply the perfumes to supports which strengthen the adherence of the perfume to the washing and which provide the textiles with a long-lasting fragrance through a slower release of the perfume. Suitable support materials are, for example, cyclodextrins, the cyclodextrin/perfume complexes optionally being coated with other auxiliaries Inorganic Salts Other suitable ingredients of the preparations are water-soluble inorganic salts, such as bicarbonates, carbonates, amorphous silicates, normal water glasses with no pronounced builder properties or mixtures thereof. One particular embodiment is characterized by the use of alkali metal carbonate and/or amorphous alkali metal silicate, above all sodium silicate with a molar $Na_2O:SiO_2$ ratio of 1:1 to 1:4.5 and preferably 1:2 to 1:3.5. The sodium carbonate content of the final preparations is preferably up to 40% by weight and advantageously from 2 to 35% by weight. The content of sodium silicate (without particular building properties) in the preparations is generally up to 10% by weight and preferably between 1 and 8% by weight.

The preparations may also contain sodium sulfate, for example, in quantities of 0 to 10% by weight and more particularly 1 to 5% by weight, based on the preparation, as a filler.

EXAMPLES

A number of formulations are presented by way of example in Table 1 below.

TABLE 1

Examples for textile treatment preparations (all quantities in % by weight)

| Composition (INCI) | 1 | 2 | 3 | 4 | 5 | 6 | 7 | 8 |
|---|---|---|---|---|---|---|---|---|
| Lamesoft ® FO<br>Glycol Distearate (and) Coco Glucosides (and) Glyceryl Oleate (and) Glyceryl Stearate | 10.0 | 15.0 | 8.0 | 10.0 | 2.0 | 4.0 | 6.0 | 10.0 |
| Texapon ® LS 35<br>Sodium Lauryl Myristyl Sulfate | 14.5 | — | 37.0 | 1.4 | — | — | — | — |
| Texapon ® 842<br>Sodium Octyl Sulfate | — | 5.9 | — | — | — | — | — | — |
| Texapon ® SP 100<br>Surfactant blend | — | 20.0 | — | — | — | — | — | — |
| Eumulgin ® WO 7<br>Oleth-7 | 10.0 | — | 2.0 | — | — | — | — | — |
| Emulgade ® CM<br>Nonionic Emulsifier Blend | — | — | — | — | — | 10.0 | 10.0 | — |
| Dehydol ® LT 7<br>Laureth-7 | — | — | — | 10.0 | — | — | — | — |
| Glucopon ® 600 CS UP<br>Coco Glucosides | 11.0 | — | 10.0 | 6.0 | — | — | — | — |

TABLE 1-continued

| Examples for textile treatment preparations (all quantities in % by weight) | | | | | | | | |
|---|---|---|---|---|---|---|---|---|
| Dehyquart ® AU 46 Bis(acyloxyethyl) hydroxyethyl methyl ammononium methosulfate | — | — | — | 7.0 | — | — | — | — |
| Edenor ® PK 18 05 Palm kernel fatty acid | 4.0 | — | — | — | — | — | — | — |
| Ethanol | 5.0 | — | — | — | — | — | — | — |
| Propylene-1,2-glycol | 5.0 | — | — | — | — | — | — | — |
| Glycerol | — | — | — | — | — | — | — | 5.0 |
| Sodium Tripolyphosphate | — | 6.0 | — | — | — | — | — | — |
| Triethanolamine | 5.0 | — | — | — | — | — | — | — |
| Starch | — | — | — | — | 40.0 | 30.0 | 20.0 | 10.0 |
| Water | | | | to 100 | | | | |
| **Composition (INCI)** | **9** | **10** | **11** | **12** | **13** | **14** | **15** | **16** |
| Lamesoft ® FO Glycol Distearate (and) Coco Glucosides (and) Glyceryl Oleate (and) Glyceryl Stearate | 5.0 | 10.0 | 18.0 | 2.0 | 5.0 | 10.0 | 5.0 | 10.0 |
| Dehyquart ® AU 46 Bis(acyloxyethyl) hydroxyethyl methyl ammononium methosulfate | — | — | — | — | 5.0 | 8.0 | 11.0 | 20.0 |
| Emulgade ® CM Nonionic Emulsifier Blend | 5.0 | 10.0 | 10.0 | 10.0 | — | — | — | — |
| Belfasin ® CCE HD Polyethylen Dispersion | 0.5 | 0.5 | — | — | — | — | — | — |
| Polyquart ® Ampho Polyacrylate | — | — | 2.0 | 2.0 | — | — | — | — |
| Aloe vera | 2.0 | — | — | 2.0 | - | 2.0 | — | 2.0 |
| Glycerol | — | — | — | — | 2.0 | — | — | — |
| Magnesium chloride | — | — | — | — | — | — | 0.6 | 0.6 |
| Water | | | | to 100 | | | | |

(1–4) Light-duty detergent,
(5–8) spray starch
(9–12) Ironing spray,
(13–14) Softener,
(15–16) Softener concentrate

We claim:

1. A method for finishing textile fibers, textile yarns, or other textiles (FYT) in order to impart a sensory effect to said textiles during use which comprises contacting the FYT with a composition comprising:

(a) 15 to 30% by weight of a mixture of waxes with melting points of 35 to 60° C. which mixture contains a lipophilic wax matrix;

(b) 10 to 20% by weight of emulsifiers comprising at least one member selected from the group consisting of alkyl oligoglycosides, alkenyl oligoglycosides and alkyl ether sulfates; and (c) 1 to 10% by weight of a crystallization regulator comprising a partial ester of a $C_{12-22}$ fatty acid with at least one alcohol selected from the group consisting of glycerol, polyglycerol and sorbitan, wherein, the quantities shown add up to 100% by weight with water and typical auxiliaries and additives and, wherein, the mean particle size of the wax crystals present therein is not greater than 6 μm.

2. The methods claimed in claim 1, wherein, component (a) comprises at least one member selected from the group consisting of monoesters of $C_{6-22}$ fatty acids with $C_{2-15}$ polyols containing at least two hydroxyl groups and diesters of $C_{6-22}$ fatty acids with $C_{2-15}$ polyols containing at least two hydroxyl groups.

3. The method claimed in claim 1, wherein, the composition contains an ester of at least one fatty acid selected from the group consisting of caproic acid, caprylic acid, 2-ethylhexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof.

4. The method claimed in claim 2, wherein, the composition contains at least one ester of a polyol selected from the group consisting of glycerol, alkylene glycols, technical oligoglycerol mixtures with a degree of self-condensation of 1.5 to 10, methylol compounds and lower alkyl glucosides.

5. The method claimed in claim 2, wherein, the composition contains at least one ester selected from the group consisting of monoesters of saturated $C_{16-18}$ fatty acids with one of ethylene glycol, propylene glycol, trimethylol propane or pentaerythritol and diesters of saturated C16-18 fatty acids with ethylene glycol, propylene, trimethylol propane or pentaerythritol.

6. The method claimed in claim 1, wherein, the composition contains as component (a) at least one fatty compound selected from the group consisting of saturated fatty alcohols, fatty ketones, fatty ethers, fatty carbonates, fatty acid alkyl esters, wherein, the fatty group contains at least 12 carbon atoms.

7. The method claimed in claim 1, wherein, the composition contains a paraffin as component (a).

8. The method of claim 1, wherein, the composition comprises as component (c) a nonionic surfactant with an HLB value of not higher than 9.

9. The method as claimed in claim 1, wherein, the composition comprises a solids content of 40 to 50% by weight.

10. The method of claim 2, wherein, the composition contains an ester of at least one fatty acid selected from the group consisting of caproic acid, caprylic acid, 2-ethylhexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof.

11. The method claimed of claim 3, wherein, the composition contains at least one ester of a polyol selected from the group consisting of glycerol, alkylene glycols, technical oligoglycerol mixtures with a degree of self-condensation of 1.5 to 10, methylol compounds and lower alkyl glucosides.

12. The method claimed in claim 3, wherein, the composition contains at least one ester selected from the group consisting of monoesters of saturated $C_{16-18}$ fatty acids with one of ethylene glycol, propylene glycol, trimethylol propane or pentaerythritol and diesters of saturated C6-18 fatty acids with ethylene glycol, propylene, trimethylol propane or pentaerythritol.

13. The method claimed in claim 4, wherein, the composition contains at least one ester selected from the group consisting of monoesters of saturated $C_{16-18}$ fatty acids with one of ethylene glycol, propylene glycol, trimethylol propane or pentaerythritol and diesters of saturated C6-18 fatty acids with ethylene glycol, propylene, trimethylol propane or pentaerythritol.

14. The method claimed in claim 2, wherein, the composition contains as component (a) at least one fatty compound selected from the group consisting of saturated fatty alcohols, fatty ketones, fatty ethers, fatty carbonates, fatty acid alkyl esters, wherein the fatty group contains at least 12 carbon atoms.

15. The method claimed in claim 3, wherein, the composition contains as component (a) at least one fatty compound selected from the group consisting of saturated fatty alcohols, fatty ketones, fatty ethers, fatty carbonates, fatty acid alkyl esters, wherein the fatty group contains at least 12 carbon atoms.

16. The method claimed in claim 4, wherein, the composition contains as component (a) at least one fatty compound selected from the group consisting of saturated fatty alcohols, fatty ketones, fatty ethers, fatty carbonates, fatty acid alkyl esters, wherein the fatty group contains at least 12 carbon atoms.

17. The method claimed in claim 5, wherein, the composition contains as component (a) at least one fatty compound selected from the group consisting of saturated fatty alcohols, fatty ketones, fatty ethers, fatty carbonates, fatty acid alkyl esters, wherein the fatty group contains at least 12 carbon atoms.

18. The method claimed in claim 6, wherein, the composition contains a paraffin as component (a).

19. The method of claim 2, wherein, the composition comprises as component (c) a nonionic surfactant with an HLB value of not higher than 9.

20. The method of claim 3, wherein, the composition comprises as component (c) a nonionic surfactant with an HLB value of not higher than 9.

* * * * *